US006504309B1

(12) United States Patent
Ohno

(10) Patent No.: US 6,504,309 B1
(45) Date of Patent: Jan. 7, 2003

(54) DRIVER CIRCUIT FOR A SELF-SCANNING LIGHT-EMITTING ARRAY

(75) Inventor: Seiji Ohno, Osaka (JP)

(73) Assignee: Nippon Sheet Glass Co., Ltd., Osaka (JP)

( * ) Notice: Subject to any disclaimer, the term of this patent is extended or adjusted under 35 U.S.C. 154(b) by 0 days.

(21) Appl. No.: 09/868,582

(22) PCT Filed: Oct. 19, 2000

(86) PCT No.: PCT/JP00/07257

§ 371 (c)(1),
(2), (4) Date: Jun. 20, 2001

(87) PCT Pub. No.: WO01/30580

PCT Pub. Date: May 3, 2001

(30) Foreign Application Priority Data

Oct. 22, 1999 (JP) ..... 11/300373

(51) Int. Cl.[7] ..... G09G 3/10
(52) U.S. Cl. ..... 315/169.1; 345/82
(58) Field of Search ..... 315/160, 169.1–169.4; 345/60, 65, 76–86

(56) References Cited

U.S. PATENT DOCUMENTS 4,100,461 A * 7/1978 Hada et al. ..... 315/169.1
5,177,405 A * 1/1993 Kusuda et al. ..... 315/169.1
6,266,036 B1 * 7/2001 Ohno ..... 345/82

* cited by examiner

*Primary Examiner*—Don Wong
*Assistant Examiner*—Wilson Lee
(74) *Attorney, Agent, or Firm*—RatnerPrestia

(57) ABSTRACT

A driver circuit for a self-scanning light-emitting element array is provided in which the same structure as a pulse current source can be realized in a simple circuit. The driver circuit comprises the first and second buffers and the first and second resistors. The first and second resistors are connected to the output terminals of the first and second buffers, respectively. The input terminal of the first buffer is connected to the first pulse voltage source, and the gate terminal is grounded. The input terminal of the second buffer is connected to the power supply (+5V), and the gate terminal is connected to the second pulse voltage source. The first and second resistors are both connected to the output terminal of the driver circuit which is connected to the clock pulse terminal.

14 Claims, 9 Drawing Sheets

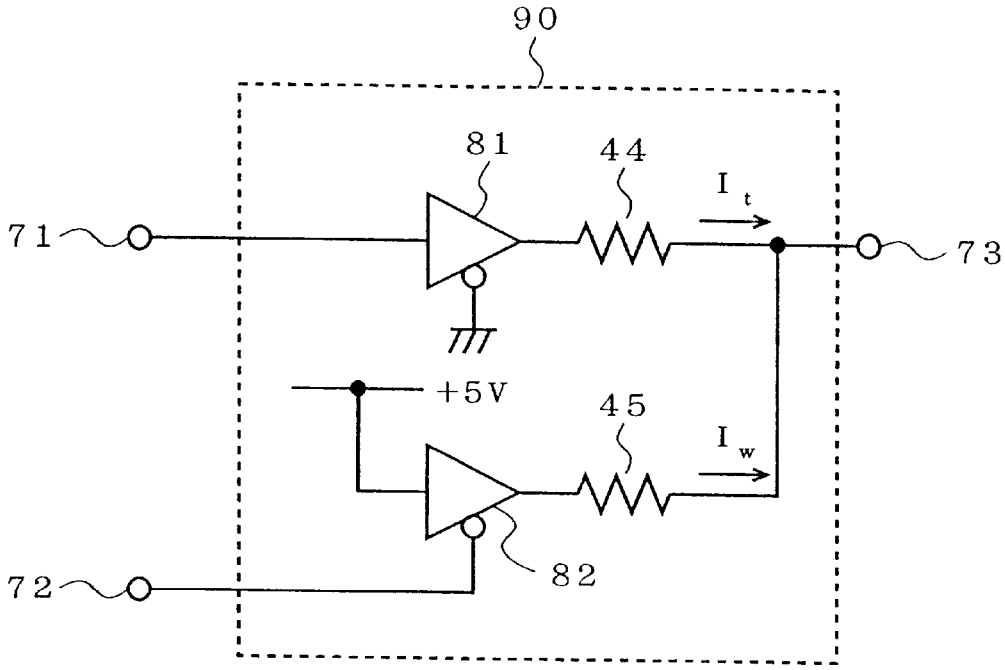
F I G. 5
| x | y | z |
|---|---|---|
| H | L | H |
| L | L | L |
| H | H | Z |
| L | H | Z |
F I G. 6 A
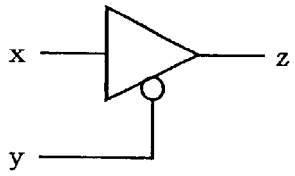
F I G. 6 B

DRIVER CIRCUIT FOR A SELF-SCANNING LIGHT-EMITTING ARRAY

TECHNICAL FIELD

The present invention relates generally to a driver circuit for a self-scanning light-emitting element array, more particularly to a driver circuit without using current sources. The present invention further relates to a self-scanning light-emitting element array using such driver circuit.

BACKGROUND ART

A light-emitting element array in which a plurality of light-emitting elements are arrayed on the same substrate is utilized as a light source of a printer, in combination with a driver circuit. The inventors of the present invention have interested in a three-terminal light-emitting thyristor having a pnpn-structure as a component of the light-emitting element array, and have already filed several patent applications (for example, Japanese Patent Publication Nos. 1-238962, 2-14584, 2-92650, and 2-92651.) These publications have disclosed that a self-scanning function for light-emitting elements may be implemented, and further have disclosed that such self-scanning light-emitting element array has a simple and compact structure for a light source of a printer, and has smaller arranging pitch of light-emitting elements.

When such a self-scanning light-emitting element array is utilized for a printer, the light emission by the elements due to a transfer operation is not desirable. Then, a self-scanning light-emitting element array has proposed, which can be escaped from the effect of light emission due to the transfer operation (see Japanese Patent Publication No. 2-263668). According to this self-scanning light-emitting array, a shift portion for a transfer function and a light-emitting portion for a light-emitting function are separated and the light-emitting thyristors are used in both portions, and the light emission of the thyristors of the shift portion is shielded by covering the thyristors by metal or the like.

Alternatively, the light output during a transfer operation may be sufficiently suppressed by using a light-emitting thyristor having a characteristic such that the light output is small in a low current area as shown in an example of I-L characteristic of FIG. 1. In the figure, an abscissa designates a current (mA) and an ordinate a light output ($\mu$W), and an arrow A shows a light emission during a transfer operation (hereinafter referred to as a transfer light-emission) and an arrow B a light emission during a write operation (hereinafter referred to as a write light-emission).

In such a case, it is unnecessary that the shift portion and light-emitting portion are separated, and a light-emitting element array serving as both the shift and light-emitting portions may be used for a light source of a printer.

In such self-scanning light-emitting element array, two kinds of currents, i.e. a current $I_t$ required for the transfer operation (hereinafter referred to as a transfer current) and a current $I_w$ required for the write operation (hereinafter referred to as a write current).

Referring to FIG. 2, there is shown an equivalent circuit diagram of a conventional self-scanning light-emitting element array to which the transfer current $I_t$ and writing current $I_w$ are applied. This self-scanning light-emitting element array is a two-phase (ϕ1 and ϕ2) driving type. In FIG. 2, $T_1$, $T_2$, $T_3$, . . . designate light-emitting thyristors, $D_1$, $D_2$, $D_3$, . . . coupling diodes, and $R_1$, $R_2$, $R_3$, . . . gate load resistors. Each cathode of thyristors is connected a substrate electrode, each anode of odd-numbered thyristors $T_1$, $T_3$, . . . is connected to a clock pulse ϕ1 line 11, and each anode of even-numbered thyristors $T_2$, $T_4$, . . . is connected to a clock pulse ϕ2 line 12. Each gate of thyristors is connected to a power supply $V_{GK}$ line 14 via the load resistors $R_1$, $R_2$, $R_3$, . . . respectively, and neighboring gate electrodes are connected to each other via the diode $D_1$, $D_2$, $D_3$, . . . , respectively. Each of lines 11, 12 and 14 is connected to a driver circuit 62 via terminals 21, 22 and 24. The gate of light-emitting thyristor $T_1$ is connected to a start pulse $\phi_s$ terminal 23.

In FIG. 2, reference numeral 10 designates the part integrated as a self-scanning light-emitting element array chip. The driver circuit 62 is added to the chip 10 externally.

The terminals 21, 22 and 23 of the chip 10 are connected to pulse voltage sources 51, 52 and 53 via current limiting resistors 41, 42 and 43, respectively, and the terminal 24 is connected to a voltage source 60. A pulse current source 31 is connected in parallel with the series circuit of the resistor 41 and the pulse voltage source 51, and a pulse current source 32 is connected in parallel with the series circuit of the resistor 42 and the pulse voltage source 52.

In the self-scanning light-emitting element array having the structure described above, the transfer current $I_t$ is generated by the resistors 41, 42 and the pulse voltage sources 51, 52. In order to cause a desired thyristor to be in a write light-emission condition, the thyristor is turned on by a transfer operation and the required write current $I_w$ is applied thereto by the pulse current sources 31 or 33.

FIG. 3 shows the wave shapes of the voltages generated by the pulse voltage sources and the currents generated by the current sources, and the conditions of the transfer light-emission and write light-emission of the thyristors. "V (numeral)" designates the voltage generated by the pulse voltage source referenced by the numeral in parentheses, "i (numeral)" the current generated by the pulse current source referenced by the numeral in parentheses, and "$L(T_n)$" the light output of the n-th thyristor $T_n$.

The light-emitting thyristors $T_1$ is turned on, when the pulse voltage v (53) of the voltage source 53 for the start pulse is at L (Low) level, and the pulse voltage v(51) of the voltage source 51 for the clock pulse ϕ1 is at H (High) level. In the wave shape of the light output $L(T_1)$, "a" designates the light output level of transfer light-emission, and "b" the light output level of write light-emission.

As described above, the on-state of the light-emitting thyristors is transferred by the repetition of the two-phase clock pulses ϕ1 and ϕ2 after the thyristor $T_1$ is turned on. The turned-on thyristor emits the light, but the light output thereof is extremely small. The write currents i(31) or i(32) is applied to the thyristor from the pulse current sources 31 or 32 in order to cause the thyristor to be in a write light-emission condition.

According to the conventional self-scanning light-emitting element array described above, there is a problem such that the pulse current source has a complicated circuit and a characteristic which varies widely.

Also, the turned-on thyristor $T_5$, for example, is in "no-writing stage" in FIG. 3, but a current is flowed via the thyristor $T_5$ to hold it on-state, so that the thyristor emits the light slightly. The light-emission in "no writing" state causes a noise, so that its light output is desirable as small as possible. In order to decrease its light output, each resistance of the resistors 41 and 42 which determines the magnitude of the transfer current $I_t$ is required to be enlarged. However, the problem is caused in that the increase of the resistance make the speed of the transfer operation slow.

DISCLOSURE OF THE INVENTION

An object of the present invention is to provide a driver circuit which can realize the same structure as a pulse current source in a simple circuit.

Another object of the present invention is to provide a driver circuit which has a function such that a light output may be decreased without lowering the speed of a transfer operation in "no-writing" state.

Further object of the present invention is to provide a self-scanning light-emitting element array which comprises such driver circuit.

A drive circuit according to the present invention is for a self-scanning light-emitting element array. The self-scanning light-emitting element array has such a structure that a plurality of three-terminal light-emitting elements are linearly arranged each having a control electrode for controlling threshold voltage or current, the control electrodes of neighboring light-emitting element are connected to each other via electrical means having unidirectional characteristic to voltage or current, two-phase clock pulses ϕ1 and ϕ2 are applied alternately to one of two terminals except the control electrode of each light-emitting element, one phase clock pulse of the two-phase clock pulses causes the threshold voltage or current of the light-emitting elements in the vicinity of a turned-on light-emitting element to vary via the electrical means, the other phase clock pulse of the two-phase clock pulses causes the light-emitting element neighbored to the turned-on light-emitting element to turn on, and the turned-on light-emitting element is caused to be in a write light-emission condition by supplying a write current thereto.

As each of the clock pulse ϕ1 and ϕ2 terminals of such self-scanning light-emitting element array has a constant voltage characteristic at an on-state of the light-emitting element, series circuits each consisting of a voltage source and a resistor are provided to the ϕ1 and ϕ2 terminals, respectively, so as to serve as current sources. As the voltage source, a buffer is used the input terminal thereof is connected to a power supply. The series circuit of the buffer and the resistor is provided between a pulse voltage source and the clock pulse terminal of a chip to input a pulse voltage outputted from the pulse voltage source to a gate terminal of the buffer.

On the other hand, a circuit for supplying the clock pulse also uses a series circuit of a buffer and a resistor to connect this series circuit to a pulse voltage source. A pulse voltage from the pulse voltage source is supplied to an input terminal of the buffer. In this case, a gate terminal of the buffer is generally grounded.

According to such driver circuit including the buffer and resistor, its structure is extremely simple compared with the conventional driver circuit, so that it may be implemented by a CMOS logic IC. The buffer furthermore may be integrated together with the resistor in the chip wherein the light-emitting elements are formed.

In order to resolve the problem such that the speed of the transfer operation is slowed when a light output is intended to be decreased in "no-writing" state, a resistance is made small during a transfer operation, and is made large after the transfer operation. Two sets of series circuit each consisting of a buffer and a resistor are provided and the ends of the resistors are connected together. The magnitude of a current flowed during a transfer operation and after the transfer operation may be changed by controlling the two sets of series circuits with the pulses supplied by pulse voltage sources, with the resistances of the two resistors being different, i.e. one is large and the other is small.

Also, such driver circuit may be implemented by CMOS logic IC, and may be integrated in a chip wherein the light-emitting elements are formed.

BRIEF DESCRIPTION OF THE DRAWINGS

FIG. 5 shows a structure of the buffer circuit in FIG. 4.

FIG. 6A shows a truth table for the buffer in FIG. 5.

FIG. 6B shows the input/output of the buffer in FIG. 5.

BEST MODE FOR CARRYING OUT THE INVENTION

Figure 1:
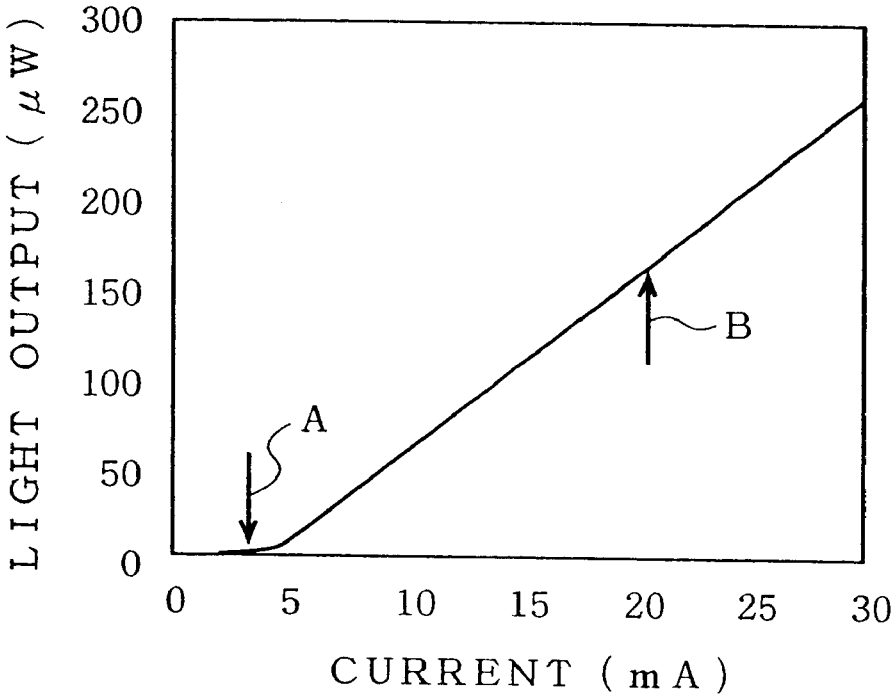
FIG. 1 shows an I-L characteristic of the thyristor in which a light output is small in a low current area.
Figure 2:
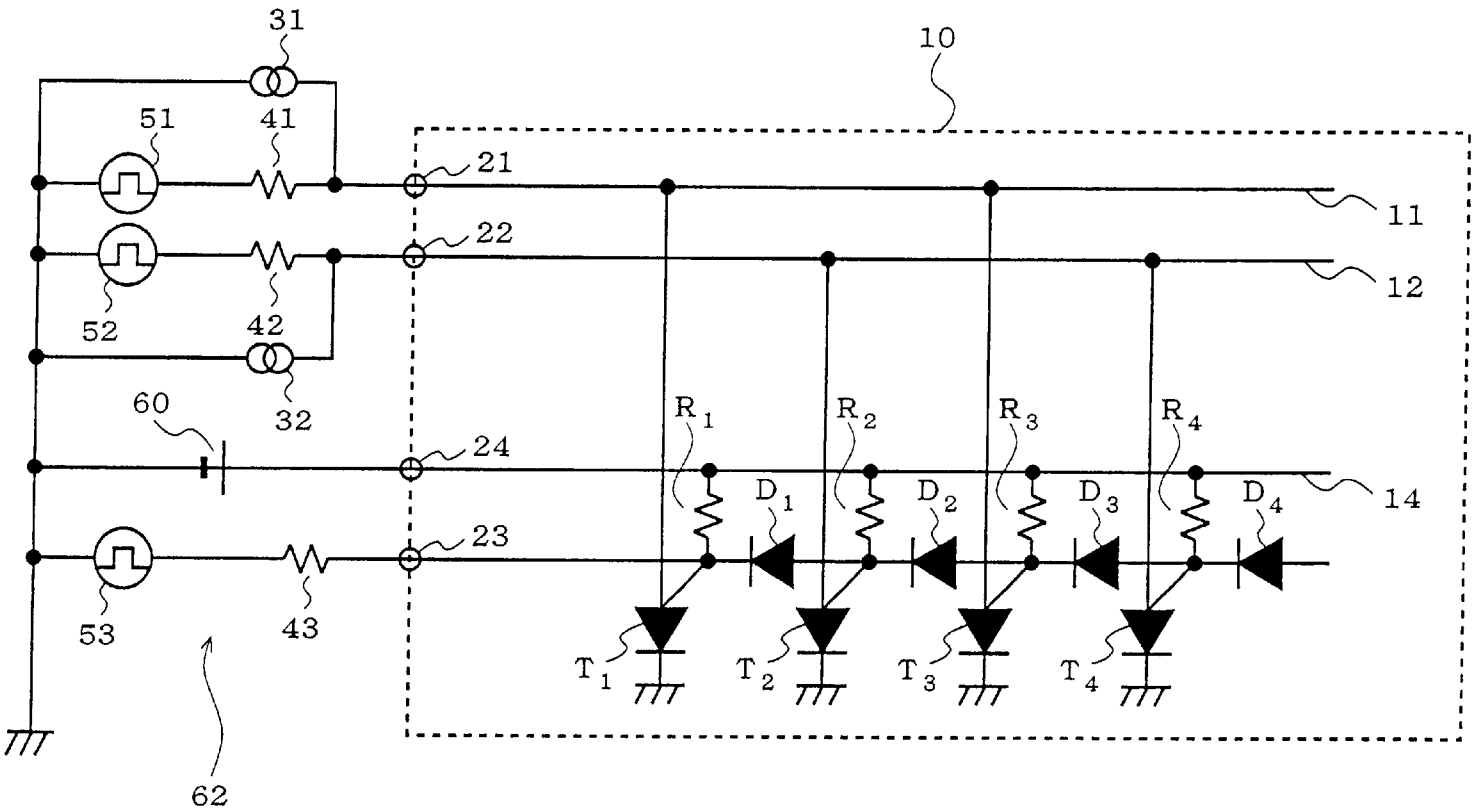
FIG. 2 shows an equivalent circuit diagram of a conventional self-scanning light-emitting element array.
Figure 4:
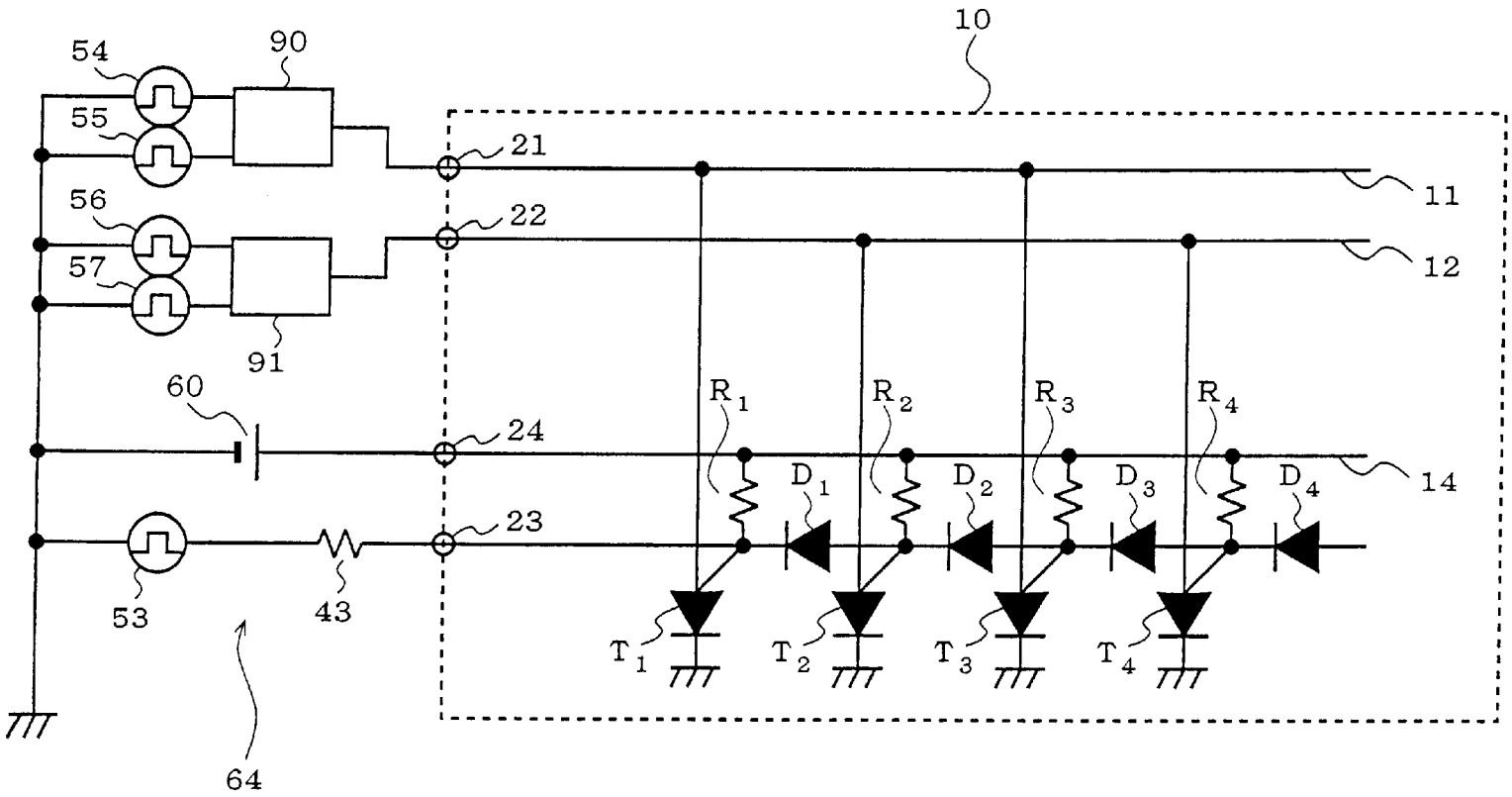
FIG. 4 shows an equivalent circuit diagram of an self-scanning light-emitting element array of an embodiment according to the present invention.

Referring to FIG. 4, there is shown an equivalent circuit diagram of an self-scanning light-emitting element array of an embodiment according to the present invention. This self-scanning light-emitting element array comprises a light-emitting element array chip 10 and a driver circuit 64 added to the chip externally. In the figure, the sam e components as in FIG. 2 are designated with the identical reference symbols and numerals in FIG. 2.

In the driver circuit 64 of this embodiment, a circuit for applying a transfer current $I_t$ and a write current $I_w$, respectively, is structured by a pulse voltage source and a buffer circuit. Concretely, the circuit connected to the clock pulse ϕ1 terminal 21 consists of pulse voltage sources 54 and 55, and a buffer circuit 90; and the circuit connected to the clock pulse ϕ2 terminal 22 consists of pulse voltage sources 56 and 57, and a buffer circuit 91.

The buffer circuits 90 and 91 are identical as to a circuit structure, then the buffer circuit 90 will be typically illustrated with reference to FIG. 5. The buffer circuit 90 comprises a buffer 81 for transfer operation, a buffer 82 for write operation, and resistor 41 and 45 connected to the outputs of the buffers, respectively. The input 71 of the buffer 81 is connected to the pulse voltage source 54, and the gate of the buffer is grounded. The input terminal of the buffer 82 is connected to a power supply (+5V), and the gate terminal 72 of the buffer is connected to the pulse voltage source 55. The resistors 44 and 45 are connected to the output terminal 73 which is connected to the clock pulse ϕ1 terminal 21.

A truth table for the buffers 81 and 82 is shown in FIG. 6A, in which "x" designates an input, "y" a gate input, and "z" an output. FIG. 6B shows the input/output of each of the buffers. It is appreciated from the table that the output of the buffer 81 for transfer operation becomes H or L level depending upon H or L level of the pulse voltage outputted from the pulse voltage source 54. The output of the buffer 81 is supplied as a transfer current $I_t$ to the terminal 21 of the chip 10. When the pulse voltage outputted from the pulse voltage source 55 is L level, the buffer 82 for write operation makes its output H level to supply a write current $I_w$ to the terminal 21. When the pulse voltage outputted from the pulse voltage source 55 is H level, the output of the buffer 82 becomes high impedance so that the write current $I_w$ is not supplied to the terminal 21.

Similarly as stated above, the buffer circuit 91 supplies a transfer current $I_t$ (a clock pulse $\phi$2) and a write current $I_w$.

The resistance of the resistor 44 is determined so as to flow the current $I_t$ required for transfer operation. Assuming that the output voltage of the buffer 81 is +5V in H level and 0V in L level, and the constant voltage at the $\phi$1 and $\phi$2 terminals 21 and 22 is 1.5V, the resistance of the resistor 44 is 3.5 k Ω to flow the transfer current of 1 mA. On the other hand, the resistance of the resistor 45 is 175Ω to flow the write current $I_w$ of 20 mA.

Figure 7:
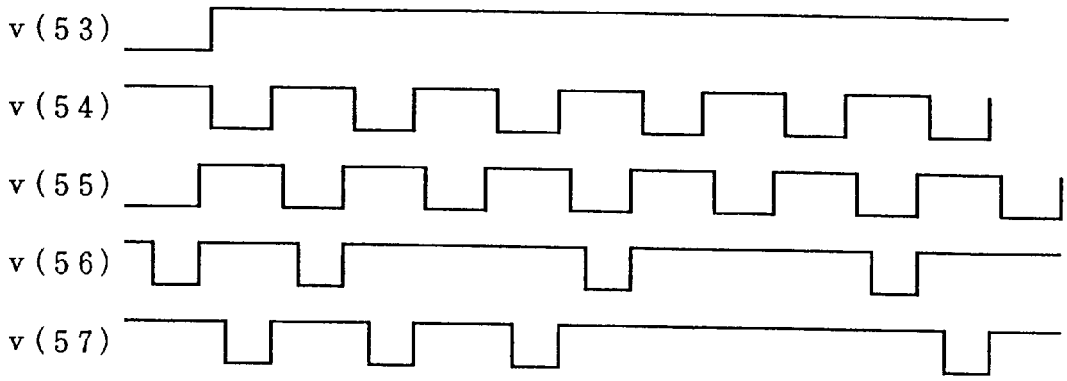
FIG. 7 shows the wave shapes of the voltages in the self-scanning light-emitting element array in FIG. 4.

FIG. 7 shows the wave shapes of the voltages v(53), v(54), v(55), v(56) and v(57). When the start pulse voltage v(53) is L level, the voltage v(54) is driven to H level so that the output voltage of the buffer 81 becomes H level as is apparent from the truth table in FIG. 6A, thereby the light-emitting thyristor $T_1$ is turned on. After that, on-state of the thyristors is transferred by the repetition of the two-phase clock pulses $\phi$1 and $\phi$2.

When one thyristor is turned on, the output voltage v(55) of the pulse voltage source 55 is driven to L level so that the output of the buffer 82 becomes H level, thereby a write current $I_w$ is flowed. As a result, the light-emitting thyristor is caused to be a write light-emission condition.

Figure 8:
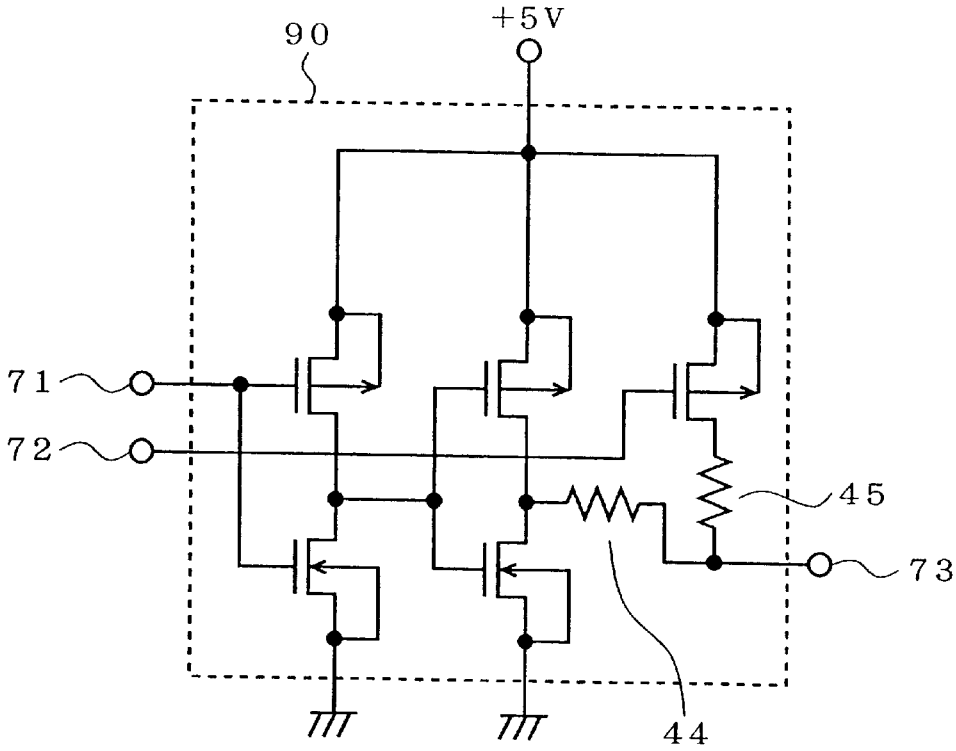
FIG. 8 shows an example of the buffer circuit in FIG. 5.
Figure 9:
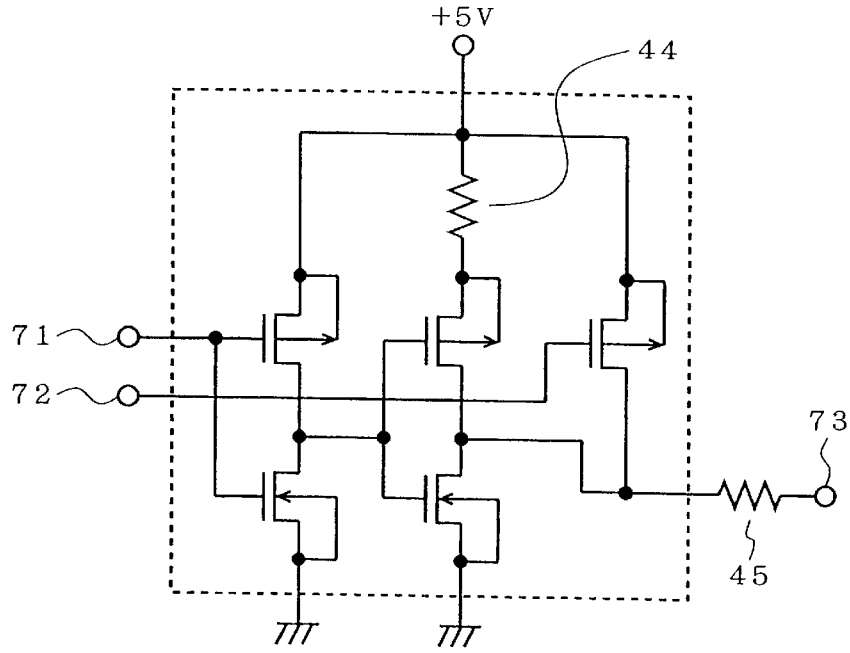
FIG. 9 shows a variation of the buffer circuit in FIG. 8.
Figure 10:
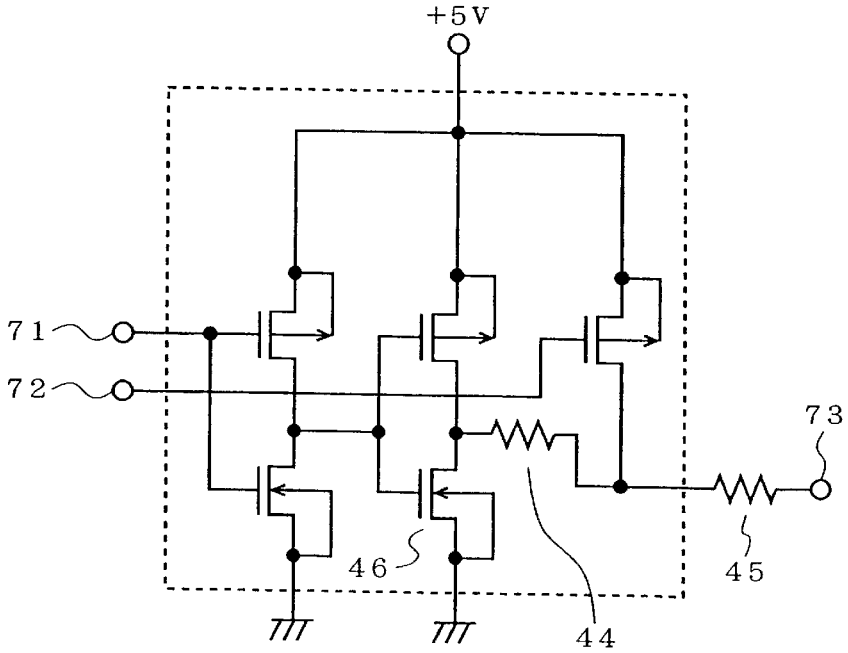
FIG.10 shows another variation of the buffer circuit in FIG. 8.

While a commercially available IC (for example, TC74VHC244 made by Toshiba, Japan) may be used for the buffers 81 and 82, it is desirable to integrate in total the buffer circuit 90 including the resistors. An example of the buffer circuit 90 integrated by using CMOS is shown in FIG. 8. As stated above, the magnitude of the write current $I_w$. is determined by the resistance of the resistor 45, it is therefore advantageous as to an accuracy of the resistance that the resistor 45 is provided outside the integrated circuit 90. FIG. 9 shows the circuit in which the resistor 45 is provided outside the integrated circuit 10. In this circuit, the resistor 44 is provided at the power supply (+5V) side, but it may be provided at a position as shown in FIG. 10. If the on-resistance of an NMOSFET 46 is enlarged by decreasing a channel width thereof, then the resistor 44 may be omitted.

Figure 3:
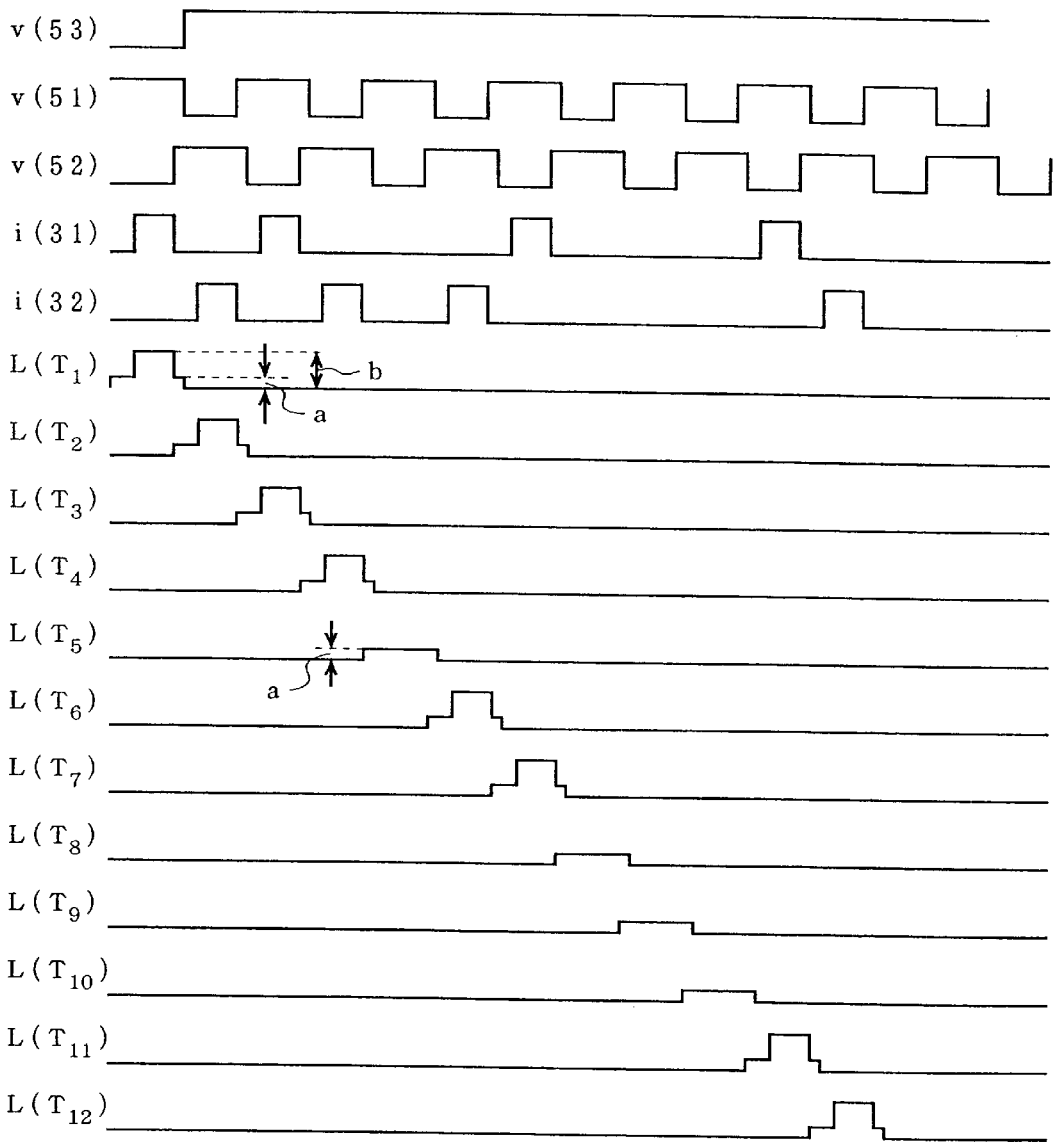
FIG. 3 shows the wave shapes for illustrating the operation of the self-scanning light-emitting element array in FIG. 2

Now back to FIG. 3, while the light-emitting thyristor $T_5$ is in "no-writing" state, it emits the light slightly (level a) because the current for holding an on-state is required. The light output in "no-writing" state is desired to be as small as possible. In order to decrease the light output, the resistance of the resistor 44 which determine the magnitude of a transfer current $I_t$ is required to be enlarged. However, when the resistance of the resistor 44 is enlarged, the problem is caused in that the speed of the transfer operation is slow as described hereinbefore. To resolve this problem, it is desirable that the resistance of the resistor 44 is made small during the transfer operation, and is made large after the transfer operation. In order to realize this, the buffer circuit 90 in FIG. 5 may be replaced by the buffer circuit 94 in FIG. 11. In the buffer circuit 94, a buffer 84 for the transfer operation is newly added, the input terminal thereof being connected to a power supply (+5V) and a gate thereof being provided with a terminal 74 connected to a pulse voltage source not shown in FIG. 4. Assume that the resistances of the resistors 91 and 94 each connected to the buffers 81 and 84 are $R_A$ and $R_B$, respectively. A light-emitting thyristor may be turned on by the current determined with the parallel resistance of $R_A$ and $R_B$ by causing the terminals 71 and 74 to be L level, respectively, during the transfer operation. After transfer operation, a holding current enough to hold on-state of the thyristor is flowed only through the resistor 91 by driving the terminal 74 to H level.

Now assuming that the holding current is 100 $\mu$A, an anode voltage of the turned-on thyristor is 1.5V, and the voltage of H level is 5V, the resistance $R_A$ is 35 k Ω. Assuming that the resistance $R_B$ is 1.03K Ω, the parallel resistance of $R_A$ and $R_B$ is 1 kΩ.

On the other hand, assuming that the resistance of the resistor 44 is 35 K Ωin the buffer circuit 90 of FIG. 5, a transfer time (i.e., a time required for transferring on-state of the thyristors) is substantially equal to a time constant which is represented by the product of a capacitance of the $\phi$1 terminal 21 (or the $\phi$2 terminal 22) and the resistance (35 k Ω) of the resistor 44. Assuming that the capacitance of the $\phi$1 terminal 21 (or the $\phi$2 terminal 22) is 30 pF, for example, the transfer time is about 1 $\mu$s. If the writing to the thyristors is going to be carried out at a rate of 500 kdot/s, then the time of write light-emission becomes about 50% with respect to the possible maximum time of write light-emission.

Figure 11:
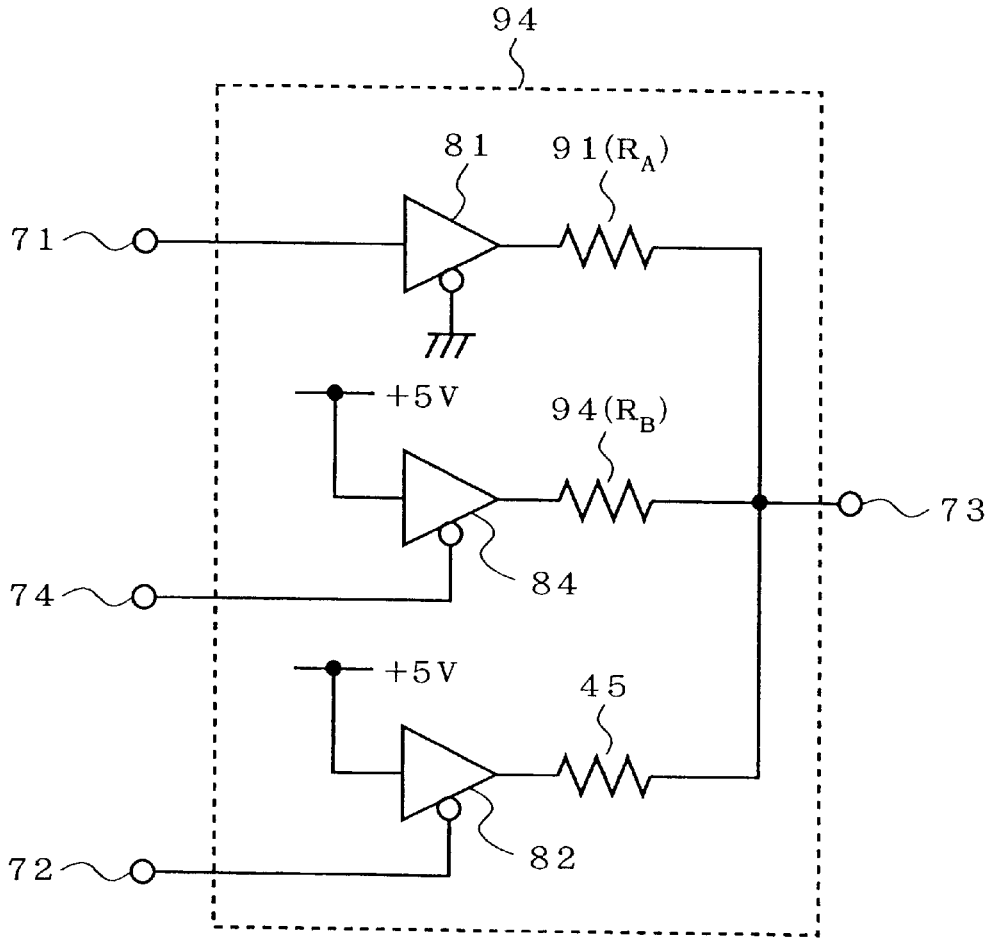
FIG. 11 shows another structure of the buffer circuit.

In constant with this, according to the method using the buffer circuit 94 shown in FIG. 11, the parallel resistance (1 kΩ) of $R_A$ and $R_B$ during the transfer operation is used, and after that only the resistance $R_A$ (35 k Ω) is used, so that the transfer time becomes 30 ns. As a result, the time of write light-emission may ensure 98.5% with respect to the possible maximum time of write light-emission.

Figure 12:
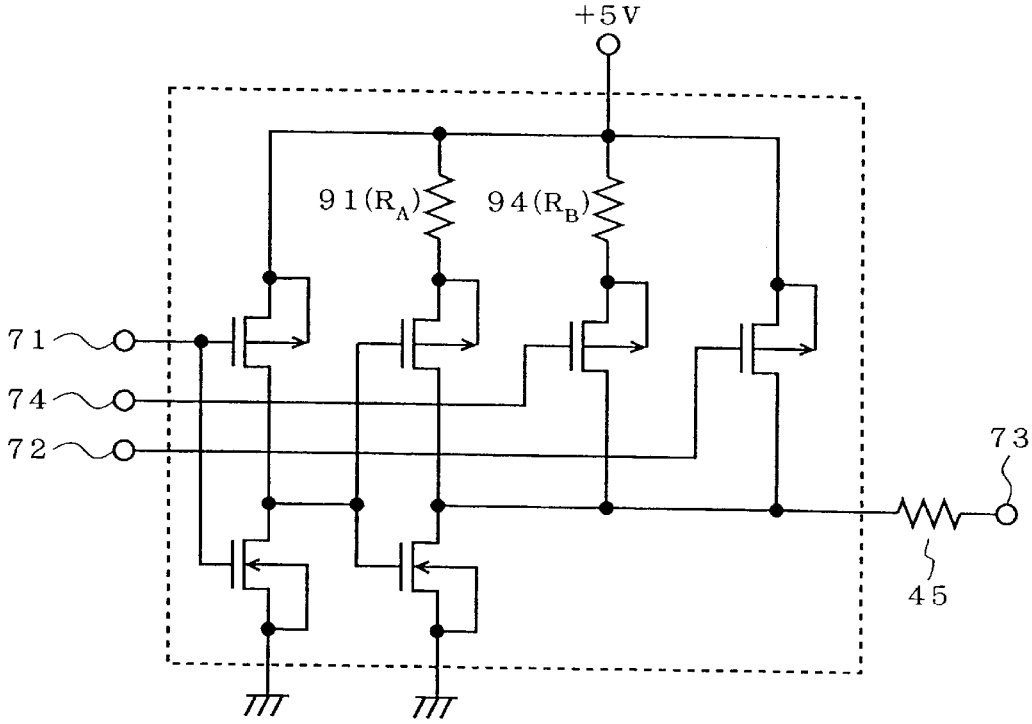
FIG. 12 shows an example of the buffer circuit in FIG. 11.

The buffer circuit 94 may be formed by CMOSs as shown in FIG. 12, which can be implemented by a integrated circuit like the circuits of FIGS. 8, 9 and 10.

In the respective embodiments described above, while the buffer circuit is provided outside the chip 10, the buffer circuit may be integrated together with the chip except the resistor 45 because a high accuracy is required for the resistor 45 which determines the magnitude of the write current $I_w$ as described hereinbefore.

INDUSTRIAL APPLICABILITY

According to the driver circuit of the present invention, a pulse current source may be implemented in a simple manner by at least one buffer and at least one resistor. Furthermore, in accordance with the present invention, a driver circuit may be provided, which has a function such that a light output may be decreased without lowering the speed of a transfer operation in "no-writing" state.

What is claimed is:

1. A driver circuit for a self-scanning light-emitting element array having such a structure that a plurality of three-terminal light-emitting elements are linearly arranged each having a control electrode for controlling threshold voltage or current, the control electrodes of neighboring light-emitting element are connected to each other via electrical means having unidirectional characteristic to voltage or current, two-phase clock pulses are applied alternately to one of two terminals except the control electrode of each light-emitting element, one phase clock pulse of the two-phase clock pulses causes the threshold voltage or current of the light-emitting elements in the vicinity of a turned-on light-emitting element to vary via the electrical means, the other phase clock pulse of the two-phase clock pulses causes the light-emitting element neighbored to the turned-on light-emitting element to turn on, and the turned-on light-emitting element is caused to be in a write light-emission condition by supplying a write current thereto, comprising a circuit for generating the clock pulse including a first pulse voltage source, a first buffer having an input terminal to which a pulse voltage from the first pulse source is supplied, and a first resistor connected to an output terminal of the first buffer; and a circuit for generating the write current including a second pulse voltage source, a second buffer having a gate terminal to which a pulse voltage from the second pulse source is supplied, an input terminal of the second buffer being connected to a power supply, and a second resistor connected to an output terminal of the second buffer.

2. The driver circuit of claim 1, wherein the resistance of the second resistor is selected so as to flow the write current required to cause the turned-on light-emitting element to be in the write light-emission condition.

3. A self-scanning light-emitting element array comprising:

an array of a plurality of three-terminal light-emitting elements linearly arranged each having a control electrode for controlling threshold voltage or current;

electrical means having unidirectional characteristic to voltage or current for connecting the control electrodes of neighboring light-emitting elements to each other;

two clock pulse lines for applying two-phase clock pulses alternately to one of two terminals except the control electrode of each light-emitting element, one phase clock pulse of the two-phase clock pulses causing the threshold voltage or current of the light-emitting elements in the vicinity of a turned-on light-emitting element to vary via the electrical means, the other phase clock pulse of the two-phase clock pulses causing the light-emitting element neighbored to the turned-on light-emitting element to turn on, and the turned-on light-emitting element being caused to be in a write light-emission condition by supplying a write current thereto;

a circuit for generating the clock pulse including a first pulse voltage source, a first buffer having an input terminal to which a pulse voltage from the first pulse source is supplied, and a first resistor connected to an output terminal of the first buffer; and a circuit for generating the write current including a second pulse voltage source, a second buffer being a gate terminal to which a pulse voltage from the second pulse source is supplied, an input terminal being connected to a power supply, and a second resistor connected to an output terminal of the second buffer.

4. The self-scanning light-emitting element array of claim 3, wherein the resistance of the second resistor is selected so as to flow the write current required to cause the turned-on light-emitting element to be in the write light-emission condition.

5. The self-scanning light-emitting element array of claim 4, wherein the first resistor and the first and second buffers are integrated together with the light-emitting elements and electrical means in a same chip.

6. The self-scanning light-emitting element array of claim 4, wherein the first and second resistors, and the first and second buffers are integrated together with the light-emitting elements and electrical means in a same chip.

7. The self-scanning light-emitting array of any one of claims 3–6, wherein the light-emitting element is a light-emitting thyristor having a characteristic such that a light output is small in a low current area.

8. A driver circuit for a self-scanning light-emitting element array having such a structure that a plurality of three-terminal light-emitting elements are linearly arranged each having a control electrode for controlling threshold voltage or current, the control electrodes of neighboring light-emitting element are connected to each other via electrical means having unidirectional characteristic to voltage or current, two-phase clock pulses are applied alternately to one of two terminals except the control electrode of each light-emitting element, one phase clock pulse of the two-phase clock pulses causes the threshold voltage or current of the light-emitting elements in the vicinity of a turned-on light-emitting element to vary via the electrical means, the other phase clock pulse of the two-phase clock pulses causes the light-emitting element neighbored to the turned-on light-emitting element to turn on, and the turned-on light-emitting element is caused to be in a write light-emission condition by supplying a write current thereto, comprising:

a circuit for generating the clock pulse including a first pulse voltage source, a first buffer having an input terminal to which a pulse voltage from the first pulse source is supplied, and a first resistor connected to an output terminal of the first buffer, a second pulse voltage source, a second buffer having a gate terminal to which a pulse voltage from the second pulse source is supplied, an input terminal of the second buffer being connected to a power supply, and a second resistor connected to an output terminal of the second buffer, the circuit being capable of varying a current in two steps both during a transfer operation of on-state of the light-emitting elements and after the transfer operation; and a circuit for generating the write current including a third pulse voltage source, a third buffer having a gate terminal to which a pulse voltage from the third pulse source is supplied, an input terminal of the third buffer being connected to a power supply, and a third resistor connected to an output terminal of the third buffer.

9. The driver circuit of claim 8, wherein the resistance of the first resistance is selected so as to be larger than that of the second resistor, and the resistance of the third resistor is selected so as to flow the write current required to cause the turned-on light-emitting element to be in the write light-emission condition.

10. A self-scanning light-emitting element array comprising:

an array of a plurality of three-terminal light-emitting elements linearly arranged each having a control electrode for controlling threshold voltage or current;

electrical means having unidirectional characteristic to voltage or current for connecting the control electrodes of neighboring light-emitting elements to each other;

two clock pulse lines for applying two-phase clock pulses alternately to one of two terminals except the control electrode of each light-emitting element, one phase clock pulse of the two-phase clock pulses causing the threshold voltage or current of the light-emitting elements in the vicinity of a turned-on light-emitting element to vary via the electrical means, the other phase clock pulse of the two-phase clock pulses causing the light-emitting element neighbored to the turned-on light-emitting element to turn on, and the turned-on light-emitting element being caused to be in a write light-emission condition by supplying a write current thereto;

a circuit for generating the clock pulse including a first pulse voltage source, a first buffer having an input terminal to which a pulse voltage from the first pulse source is supplied, and a first resistor connected to an output terminal of the first buffer, a second pulse voltage source, a second buffer having a gate terminal to which a pulse voltage from the second pulse source is supplied, an input terminal of the second buffer being connected to a power supply, and a second resistor connected to an output terminal of the second buffer, the circuit being capable of varying a current in two steps both during a transfer operation of on-state of the light-emitting elements and after the transfer operation, and a circuit for generating the write current including a third pulse voltage source, a third buffer having a gate terminal to which a pulse voltage from the third pulse source is supplied, an input terminal of the third buffer being connected to a power supply, and a third resistor connected to an output terminal of the third buffer.

11. The self-scanning light-emitting array of claim 10, wherein the resistance of the first resistance is selected so as to be larger than that of the second resistor, and the resistance of the third resistor is selected so as to flow the write current required to cause the turned-on light-emitting element to be in the write light-emission condition.

12. The self-scanning light-emitting element array of claim 11, wherein the first and second resistors and the first, second and third buffers are integrated together with the light-emitting elements and electrical means in a same chip.

13. The self-scanning light-emitting element array of claim 11, wherein the first, second and third resistors, and the first, second and third buffers are integrated together with the light-emitting elements and electrical means in a same chip.

14. The self-scanning light-emitting array of any one of claims 10–13, wherein the light-emitting element is a light-emitting thyristor having a characteristic such that a light output is small in a low current area.

* * * * *

UNITED STATES PATENT AND TRADEMARK OFFICE

CERTIFICATE OF CORRECTION

PATENT NO. : 6,504,309 B1 
DATED : January 7, 2003
INVENTOR(S) : Seiji Ohno

It is certified that error appears in the above-identified patent and that said Letters Patent is hereby corrected as shown below:

Column 2,
Line 34, "light-emission and write light-emission of the thyristors. "V" should read
-- light-emission and write light-emission of the thyristors. "v --.

Column 4,
Line 41, "In the figure, the sam e components" should read -- In the figure, the same components --.

Column 5,
Line 42, "As stated above, the magnitude of the write current $I_{w.}$ is" should read
-- As stated above, the magnitude of the write current $I_w$ is --.

Column 6,
Line 15, "Assuming that the resistance RB is 1.03K Ω, the parallel" should read
-- Assuming that the resistance RB is 1.03k, Ω, the parallel --.
Line 18, "resistor 44 is 35 K Ωin the buffer circuit"should read
-- resistor 44 is 35kΩ in the buffer circuit --.

UNITED STATES PATENT AND TRADEMARK OFFICE

CERTIFICATE OF CORRECTION

PATENT NO. : 6,504,309 B1
DATED : January 7, 2003
INVENTOR(S) : Seiji Ohno

It is certified that error appears in the above-identified patent and that said Letters Patent is hereby corrected as shown below:

Column 7,
Line 7, "comprising" should read -- comprising: --.
Lines 45-50, "a circuit for generating the clock pulse including a first pulse voltage source, a first buffer having an input terminal to which a pulse voltage from the first pulse source is supplied, and a first resistor connected to an output terminal of the first buffer" should read -- a circuit for generating the clock pulse including a first pulse voltage source, a first buffer having an input terminal to which a pulse voltage from the first pulse source is supplied, and a first resistor connected to an output terminal of the first buffer --.

Signed and Sealed this

Fourth Day of May, 2004

JON W. DUDAS
*Acting Director of the United States Patent and Trademark Office*